US009394769B2

(12) United States Patent
Nenniger

(10) Patent No.: US 9,394,769 B2
(45) Date of Patent: Jul. 19, 2016

(54) INFLOW CONTROL VALVE FOR CONTROLLING THE FLOW OF FLUIDS INTO A GENERALLY HORIZONTAL PRODUCTION WELL AND METHOD OF USING THE SAME

(71) Applicant: John Nenniger, Calgary (CA)

(72) Inventor: John Nenniger, Calgary (CA)

( * ) Notice: Subject to any disclaimer, the term of this patent is extended or adjusted under 35 U.S.C. 154(b) by 46 days.

(21) Appl. No.: 14/364,864

(22) PCT Filed: Dec. 14, 2012

(86) PCT No.: PCT/CA2012/001146

§ 371 (c)(1),
(2) Date: Jun. 12, 2014

(87) PCT Pub. No.: WO2013/086616

PCT Pub. Date: Jun. 20, 2013

(65) Prior Publication Data

US 2015/0013978 A1 Jan. 15, 2015

(30) Foreign Application Priority Data

Dec. 16, 2011 (CA) ..... 2762480

(51) Int. Cl.

| | |
|---|---|
| ***E21B 43/12*** | (2006.01) |
| ***E21B 34/08*** | (2006.01) |
| ***E21B 43/24*** | (2006.01) |
| ***E21B 43/16*** | (2006.01) |
| *E21B 43/30* | (2006.01) |

(52) U.S. Cl.

CPC ..... *E21B 43/12* (2013.01); *E21B 34/08* (2013.01); *E21B 43/166* (2013.01); *E21B 43/2406* (2013.01); *E21B 43/305* (2013.01)

(58) Field of Classification Search

CPC ..... E21B 43/14; E21B 43/305; E21B 23/02; E21B 34/10; E21B 34/08; E21B 21/10

See application file for complete search history.

(56) References Cited

U.S. PATENT DOCUMENTS

| | | | | |
|---|---|---|---|---|
| 6,622,791 | B2 | 9/2003 | Kelley et al. | |
| 2005/0072567 | A1 | 4/2005 | Steele et al. | |
| 2006/0076150 | A1 | 4/2006 | Coronado et al. | |
| 2011/0139432 | A1 * | 6/2011 | Freeman | E21B 43/24 166/57 |

FOREIGN PATENT DOCUMENTS

| | | |
|---|---|---|
| WO | WO 2009/113870 A2 | 9/2009 |
| WO | WO 2011/098328 A2 | 8/2011 |

OTHER PUBLICATIONS

International Search Report for corresponding PCT Application No. PCT/CA2012/001146 dated Apr. 8, 2013.

* cited by examiner

*Primary Examiner* — Zakiya W Bates
(74) *Attorney, Agent, or Firm* — Fay Sharpe LLP

(57) ABSTRACT

An inflow control valve has a valve body having a threaded portion for connecting the valve body to a production tubing, a through bore for connecting the valve body to an inside bore of the production tubing and an outside surface; at least one inlet passageway extending through the valve body between the outside surface and the through bore and an inlet opening on the at least one inlet passageway formed on the outside surface of the valve body; a closure member for opening and closing the inlet opening, the closure member being located between the inlet opening and the annulus; and a member to bias the closure member to an open position when the inlet opening is submerged in a liquid to be recovered from the reservoir and to bias the closure member to a closed position in the absence of the liquid at the inlet opening.

26 Claims, 11 Drawing Sheets

INFLOW CONTROL VALVE FOR CONTROLLING THE FLOW OF FLUIDS INTO A GENERALLY HORIZONTAL PRODUCTION WELL AND METHOD OF USING THE SAME

FIELD OF THE INVENTION

This invention relates to the field of in situ hydrocarbon extraction and more particularly to the extraction of conventional oil, heavy oil and bitumen from underground formations using extraction processes which use generally horizontal production wells. Most particularly this invention relates to methods and apparatuses to control the inflow of fluids into the horizontal production well to improve the overall thermal efficiency of the production of hydrocarbons from such horizontal wells.

BACKGROUND OF THE INVENTION

Horizontal wells are now used extensively in the production of hydrocarbons from underground formations or reservoirs. Gravity drainage is an emerging technique that uses horizontal wells and it promises to greatly increase the economically recoverable reserves of oil. In a gravity drainage process, a typical well configuration involves paired horizontal wells: one for vapour injection; and a second one for liquid production. An extraction chamber is formed in the pay zone around the injection well generally above the production well. Fluids, mobilized by the recovery process, drain towards the bottom of the pay zone forming a liquid sump. Steam Assisted Gravity Drainage (SAGD) is one form of gravity drainage extraction, carbon dioxide enhanced oil recovery is another emerging gravity process for conventional and heavy oil which may grow in importance due to carbon capture and storage.

In a gravity drainage process, the production well is located towards the bottom of the pay zone so it is preferentially submerged in draining liquids. The vapour and extraction chamber expand upward and outward as more fluids drain towards the bottom of the chamber. The production well, located within a well casing, is typically divided into two main sections—a generally horizontal inflow section that contains perforations, screens, slots or the like to permit fluid to flow into the well casing while keeping out sand and the like, and a riser section that has no perforations and acts as a fluid conduit to bring fluids to surface. The riser section may be generally vertical or may be sloped depending upon the reservoir depth and drilling pattern used.

It is currently understood that an efficient gravity drainage process ensures that mostly liquid is withdrawn from the chamber through the production well. The prior art teaches that this can be achieved by restricting the production from the well to ensure that the horizontal portion of the production well and thus the inlet perforations are always submerged under liquid in a sump. This liquid submergence is supposed to prevent vapour, being injected at pressure into the chamber above from passing directly into the production well without any beneficial extraction or oil mobilization effect. Any vapour that passes into the production well represents a loss of efficiency for the extraction process because it is unable to deliver its latent heat and/or its solvent content to the oil to be recovered.

Even in the case of gas assisted gravity drainage, where an inert gas is injected into the vapour chamber without any intention of mobilizing the oil but simply to help fill the voidage volume in the extraction chamber, the loss of gas into the production well is undesirable. Typically any such vented gas must be separated at surface from the produced fluids, dried, recompressed and re-injected at considerable cost.

In SAGD, limiting the fluid production from the extraction chamber to liquids (i.e. hot water and hot bitumen) is called steam trap control. This steam trap control should reduce the use of steam as compared to say a cyclic steam extraction (so called "huff and puff") because live steam is unavoidably vented during the "puff" production phase of the latter process thereby greatly reducing the thermal efficiency of the extraction. But this has not proved to be the case.

Maintaining the liquid submergence by controlling the fluid withdrawal rate is very challenging. If the liquid drainage at the rate at a particular location along the horizontal production well is too slow, the fluid level at that location can rise and even submerge the vapour injection well. In SAGD, locations that are flooded cannot be effectively heated by the injected steam, leading to a risk of having the bitumen cool down in that local area, become too viscous to drain, and thereby render portions of the horizontal well less productive or even completely unproductive.

In some reservoirs the extraction chamber can detach from the injection well and expand upwards until the stream reaches the top of the pay zone. This is very undesirable because the steam heating may become focused on the cap rock at the top of the pay zone which is unproductive, and fluid drainage to the production well may be limited to a few "chimneys". Further this misplaced heating may allow the production well to cool off so much that produced fluids in the liquid sump become too viscous to flow without excessive pressure drive. This has been referred to as "pancaking" of the steam chamber.

One way to address the pancaking risk is to use very high drawdown pressures across the production well to try to aggressively drain any mobilized fluids. Unfortunately, aggressive drawdown pressures also inevitably leads to steam vapour breakthrough at one or more locations along the length of the horizontal well and direct production of steam through the production well. Direct production of steam leads to high energy consumption and excess greenhouse gas production both of which are expensive and highly undesirable as outlined below.

Heat balance calculations suggest that currently about half of the latent heat from steam injected into SAGD wells cannot be accounted for. However, the water material balance for most SAGD projects is quite reasonable, so steam (water) isn't "lost" even though its latent heat cannot be accounted for. Government funded studies report that the ideal energy requirement for SAGD should be in the range of 0.6 to 0.75 GJ per barrel of bitumen, which is much less than is actually being achieved in a typical facility. Based on the greenhouse gas emissions, as reported by environment Canada and production data for thermal oil projects as reported by the ERCB, the GHG intensity for thermal oil in Alberta averaged about 90 kg $CO_2$ eq/bbl in 2009. Since natural gas is the primary fuel, the energy requirement for thermal oil in 2009 was about 1.6 GJ/bbl or more than twice as high predicted by the studies. This discrepancy can only be explained by an excess of steam being directly produced through the production well.

What is desired is a better way to limit the inflow of steam or vapour into a production well and in particular to a horizontal production well of the type used in a gravity drainage extraction process. Most preferably such a way of limiting flow would be compatible with high drawdown pressures of the type typically used in SAGD production.

U.S. Pat. No. 7,290,606 to Coronado et al presents a form of inflow control valve for a production well that can block the inflow of water, for example, into an oil well. This patent teaches using a moveable flapper valve or rotating valve at the end of an inlet passageway between an annulus and an inside of the production tubing. The patent teaches that the moveable valve is responsive to the fluid density surrounding the valve, i.e. within the production tubing. However, this design has several problems that make it unsuitable for SAGD applications or any other processes that operate close to bubble point conditions as set out below.

A first problem is that in some embodiments the moveable valve is designed in a way that permits it to be actuated by pressure drawdown. For example, pressure drop exerts an opening force on the flappers of designs shown in FIGS. 3A, 3B and 3C of U.S. Pat. No. 7,290,606, (column 7 lines 51-63) leaving these designs vulnerable to open inappropriately. This would permit vapour to escape by reason of drawdown pressure, which is the exact problem that operators currently face.

A second problem is that the flow restriction element may be located downstream of a flow passageway from the annulus. This downstream position renders the design unsuitable for SAGD because a small reduction in pressure within the production tubing can lead to substantive flashing of bubble point liquid into the vapour phase. A flow restriction element positioned downstream will be affected by vapour within the production tubular and tend to keep the valve closed, even though the production well may be fully submerged in liquid.

A third problem, is responsiveness since, as shown in FIGS. 6 and 7 of Coronado, sleeve 242 is symmetrical and evenly balanced. Eventually, if exposed to water, it would close, but in a dirty and viscous environment, such as normally found in SAGD production (with high viscosity bitumen and grit or sand), the meta-stable design will be slow to overcome the unavoidable and inevitable friction. Thus, the design favours and is intended for a one time shut-off, rather than a more responsive open/closed./open etc. valve as is required for example in SAGD.

A final problem is that the valve taught aligns itself with a predetermined orientation upon being positioned within the well bore, and then may be sealed to the casing, for example, with expanding seals. Such an alignment perpetuates the meta-stable position of the flow restriction element, thus ensuring the valve is unresponsive to changes in conditions. These and other limitations that will be apparent to those skilled in the art mean that this prior art device is of limited, if any, use in gravity drainage processes.

An inflow control device for SAGD is described by Wat et al Canadian Patent Application 2,692,939. FIG. 6 shows this device uses pressure drop across the valve to regulate the flow. A problem with a device which responds to pressure drop is that the pressure drop is not necessarily related to liquid levels in the sump around the production well.

What is desired therefore is a device that is suitable for use in a gravity drainage extraction process such as SAGD and which overcomes the issues associated with the prior art designs. Most preferably such a design would be able to rapidly and accurately respond to the presence or absence of liquid in the annulus to permit liquid bitumen to flow into a production well while preventing excess production of vapours such as steam. Such a design would not align itself with a predetermined position, but would move or change position as required to achieve optimum operation. Most preferably such a design would open and close without regard to the size of any pressure draw downs across the valve that might be required to ensure good SAGD performance and drainage across the reservoir. Such a device must be capable of effectively draining liquid from the chamber, to prevent flooding and pancaking. Such a device must be physically robust, operating for long periods of time and reliably rapidly cycling open and closed as the produced liquids are drained from the annulus and then allowed to refill, before being drained again.

SUMMARY OF THE INVENTION

The present invention comprehends a method and apparatus comprising an inflow control valve which opens or closes to allow liquid flow into the production well but restricts vapour production or loss from the vapour chamber to the production tubing. More generally, what is comprehended is a valve to enable operators to apply substantive pressure drawdown while still maintaining adequate liquid submergence, because the pressure drawdown does not affect the performance of the inflow control device. In other words the present invention is intended to provide a design that can open and close reliably despite being subjected to a dynamic (highly variable) pressure drawdown.

The present invention further presents an apparatus is intended to respond appropriately to bubble point fluids, which are prone to flashing by being able to open and close to in response to changes in liquid submergence rather than to a pressure drop across the valve. As well the design is relatively simple and efficient. The present invention further provides a design that moves in position as required to produce an effective amount of torque from a starting position, and is not metastable and thus can reliably overcome inevitable friction and viscous resistance to provide rapid and reliable opening and closing actuation.

According to the present invention the inflow control device can be deployed at numerous locations along the production tubing in a horizontal well. According to a further aspect of the present design better inflow control permits the horizontal wells to be extended in length to thereby reduce surface environmental footprint as well as achieve greater economies of scale. Further the present invention is intended to provide an apparatus and/or method that enables a more efficient use of steam, water and fuel energy and reduces GHG emissions as compared to the prior art. Further, better drainage will enable thinner pay zones to be effectively recovered. Better drainage control will enable better recovery of more challenging in situ conditions such as ones that may be wetter and leaner than is ideal.

The invention consists of an inflow control valve positioned in the production tubing that allows fluid to flow from the tubing-casing annulus of the production well into the production tubing. This valve includes a buoyancy activated valve member that is directly exposed to the annulus fluids to ensure and respond to liquid submergence at an inlet opening to the production tubing. The valve opens when the inlet opening is submerged in liquid and preferentially closes in the absence of such liquid submergence.

The present invention comprehends that such inflow control valves can be easily installed along the production tubing through conventional well tool installation techniques. Any number of these valves can be placed along the extended horizontal wellbore to provide optimized local drainage for individual or short sections of the horizontal production well and thereby keep the liquid sump in the gravity drainage chamber at a desired minimum amount. At the same time the present invention is intended to prevent steam break through to the production tubing even in the presence of a significant drawdown pressure.

Therefore according to a preferred aspect the present invention provides an inflow control valve for controlling the flow of fluids into a generally horizontal production well located in an underground reservoir, said production well having a well casing, production tubing located within the casing and an annulus between said production tubing and said casing, said inflow control valve comprising:

a valve body having a means for connecting the valve body to said production tubing, a through bore for connecting said valve body to an inside bore of said production tubing and an outside surface;

at least one inlet passageway extending through said valve body between said outside surface and said through bore;

an inlet opening on said at least one inlet passageway formed on said outside surface of said valve body;

a closure member for opening and closing said inlet opening, said closure member being located between said inlet opening and said annulus; and a means to bias said closure member to an open position when said inlet opening is submerged in a fluid to be recovered from said reservoir and to bias said closure member to a closed position in the absence of said fluid at said inlet opening.

According to a further aspect the present invention provides a method of controlling the flow of fluid into a horizontal production well located within a casing and having an annulus formed between the casing and the production well, the casing and the horizontal production well being located within an underground hydrocarbon reservoir, the method comprising the steps of:

providing at least one inlet flow control valve in said horizontal production well which opens and closes in accordance with a liquid immersion level of said valve;

injecting a vapour into an underground formation above said production well to reduce a viscosity of in situ hydrocarbons sufficiently so that the hydrocarbons can drain as a liquid towards and into said production well; and permitting liquid to pass through said inflow control valve when said annulus is at least partially full of said liquid and thereby preventing vapour from passing into said production tubing.

According to yet a further aspect of the present invention there is provided an inflow control valve for controlling the flow of fluids into a generally horizontal production well located in an underground reservoir, said production well having a well casing, production tubing located within the casing and an annulus between said production tubing and said casing, said inflow control valve comprising:

a valve body including at least one inlet flow control orifice; and a submergence responsive means operatively connected to said orifice having an upstream side in fluid communication with a fluid in said annulus and a downstream side in fluid communication with production tubing, wherein said submergence responsive means opens and closes access to said orifice in response to liquid level changes in said fluid in said annulus, to maintain a desired amount of liquid submergence at the inlet orifice.

BRIEF DESCRIPTION OF THE DRAWINGS

Reference will now be made, by way of example only, to preferred embodiments of the present invention in which.

DETAILED DESCRIPTION OF THE PREFERRED EMBODIMENTS

In this description the following terms shall be understood to have the following meanings. The terms vertical and horizontal are meant to indicate generally vertical or horizontal. For example, it is common to refer to a horizontal production well that may not in practice be straight or perfectly horizontal, but is generally more horizontal than vertical. The same applies to the term vertical, which in this case means more vertical than horizontal. The term "riser" means that portion of the wellbore or production tubing that extends from the underground reservoir to the surface to transport the production fluids. Many well configurations and drill patterns can be used and the precise shape and slope of production wells and risers can vary considerably without departing from the scope of the present invention. In this specification the term fluids shall comprehend both liquids and gases and combinations thereof. In some cases the fluids will also contain mixtures of two different fluids, such as water and oil. Vapour means a form of gas, such as steam and liquid means having a consistency like mobilized bitumen or water, neither a solid nor a gas.

In this specification, a clockwise rotation means a rotation that is in the clockwise direction as viewed from the toe of the well. A clockwise rotation is produced by the application of a positive torque or biasing force. Similarly, a negative torque or biasing force is defined as one which produces a counter-clockwise rotation as viewed from the toe of the well. The present invention is not limited to the particular directions and orientations described which are provided by way of example and explanation only.

Figure 1:
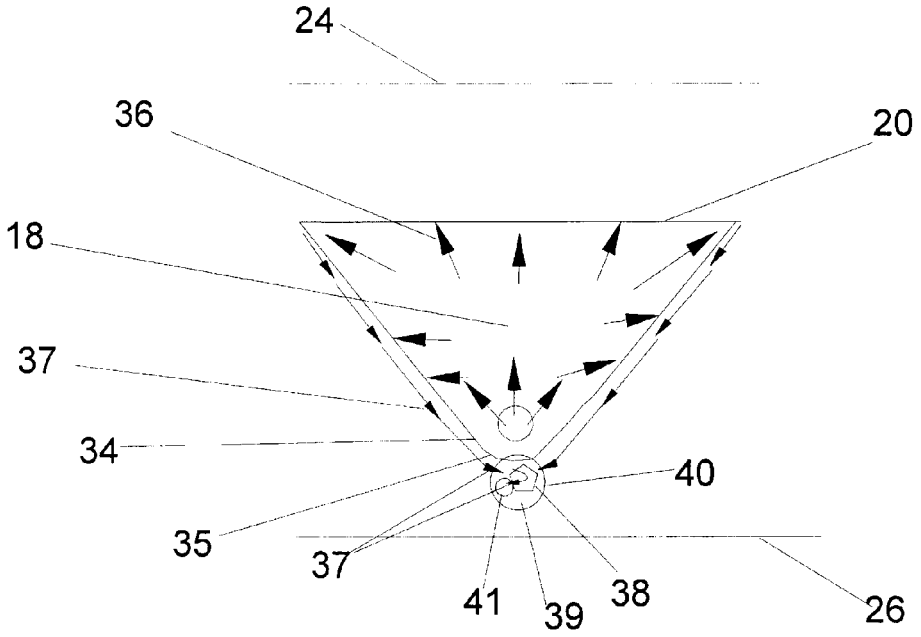
FIG. 1 shows a cross section of a horizontal gravity drainage chamber with an inflow control valve installed on a generally horizontal well according to the present invention.

FIG. 1 shows a cross section of a horizontal gravity drainage chamber 18 for a typical SAGD extraction process and which is used to illustrate the features of the present invention. As shown, 20 is a top of an extraction or vapour chamber 18. An overburden layer 24 and an underburden layer 26 are part of the underground formation in which the reservoir is located. The term reservoir refers to where there is hydrocarbons or pay and is found between the overburden 24 and the underburden 26.

FIG. 1 also shows an injection well 34 which is used to inject a vapour, for example, steam 36 (large arrows) through perforations 33. This steam 36 travels to any location in the chamber 18 which is cooler than the saturation temperature of the steam and condenses. In this way the steam delivers heat to the location at which it condenses. The released heat reduces the viscosity of the bitumen enough for it to flow (shown by smaller arrows 37). The bitumen drains by gravity towards the bottom of the chamber 18 together with any condensed steam (hot water). At the bottom of the chamber the generally horizontal production well casing 40 collects the bitumen and condensed water. They then pass into production tubing 41 to be transported to surface by either artificial or natural lift through a generally vertical riser section. The casing 40 has entry means such as slots, screens or the like to allow fluid 37 inflow into the wellbore while keeping out sand and the like. The production tubing 41 is placed inside the casing 40 thereby defining an annulus 39 between the production tubing and the casing.

In gravity drainage production it is desirable to maintain the vapour liquid interface 35 at a position intermediate between injection well 34 and production well casing 40, so the production well casing 40 is always submerged in liquid—the so called steam trap control. On the other hand too much liquid accumulation could flood the chamber 18, leading to a loss of production. The present invention provides an inflow control valve 38 which is shown schematically in FIG. 1 as a pentagon shape to control liquid inflow into the production tubing from the annulus. According to the present invention when the level of liquid 37 in the casing-tubing annulus 39 is above a certain threshold, as described below, the valve 38 opens to allow this liquid to flow from the casing-tubing annulus 39 of the production well into the production tubing 41. Conversely, the inflow control valve 38 will close to restrict fluid flow into the production tubing 41 when the liquid level in the annulus is below a preferred threshold thereby limiting the amount of vapour that can pass directly from the chamber 18 into the annulus, through the inflow control valve and into the production tubing 41.

Figure 2:
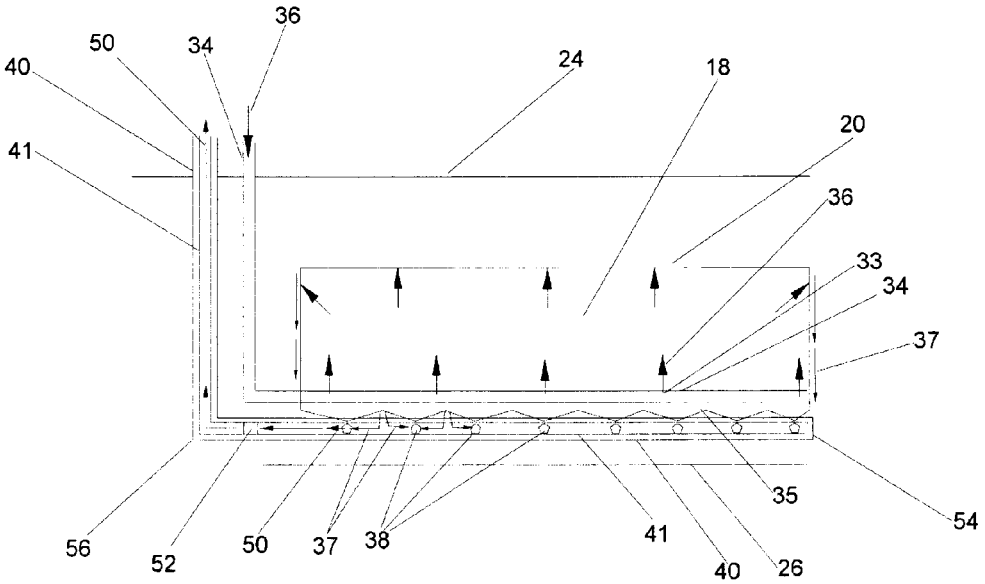
FIG. 2 shows a cross section of a SAGD gravity drainage chamber of FIG. 1 showing a series of inflow control valves according to the present invention installed along the production tubing within the production well.

FIG. 2 shows a cross section of a SAGD gravity drainage chamber 18 of FIG. 1, along the length of the horizontal wells. Again the overburden 24 and underburden 26 are shown. Steam 36 is injected into the injection well 34. This steam travels across the chamber 18 and condenses on an extraction interface, losing its heat to the bitumen saturated sand and warming the bitumen enough so that it begins to flow. The mobilized bitumen and condensed steam (i.e. hot water) drain (small arrows) 37 towards the bottom of the chamber 18 forming a liquid sump with a liquid/vapour interface 35 at the top of the liquid sump. The position of the liquid/vapour interface is maintained between the injection well 34 and the production well 40 by withdrawing liquid 37 into the production well at an appropriate rate. The inflow control valves 38 of the present invention (shown schematically as pentagons) open and close in response to the liquid levels immediately adjacent to each inflow control valve. Liquid that flows through the valves 38 is commingled with other liquid 50 already within the production tubing 41. The direction of flow within the production tubing is from the toe 54 towards the heel 56. A pressure driving force for this fluid flow may be provided or an artificial lift 52 may be provided.

In a preferred embodiment, the invention consists of an inflow control valve 38, which opens and closes to maintain liquid submergence of an inlet opening on the valve 38. Produced liquid in SAGD being a mixture of water and oil/bitumen passes through inflow control valve 38 travels along the tubing 41 and up the generally vertical portion of the production well. The liquid may geyser, ie flash back to vapour, as the pressure drops as the fluid rises. A mixture of steam vapour, hot water and hot bitumen at the wellhead 50 is then sent to the surface processing facility.

In a long horizontal well, it is desirable to have multiple valves 38 positioned along the tubing 41 to minimize the distance that the fluid must flow to enter the tubing and thereby enable efficient local drainage of the annulus into the production tubing along the entire length of the horizontal wellbore. This is particularly helpful in order to achieve longer SAGD wells. Longer SAGD wells offer greatly reduced capital costs and a reduced environmental footprint because the number of well pads, wellheads and flowlines are all directly related to the length of the horizontal wells. Efficient drainage also allows the injection well to be placed closer to the production well, as well as reducing the inventory of mobilized hydrocarbon fluid that is held in the sump. The present invention facilitates efficient drainage as explained below.

Figure 3:
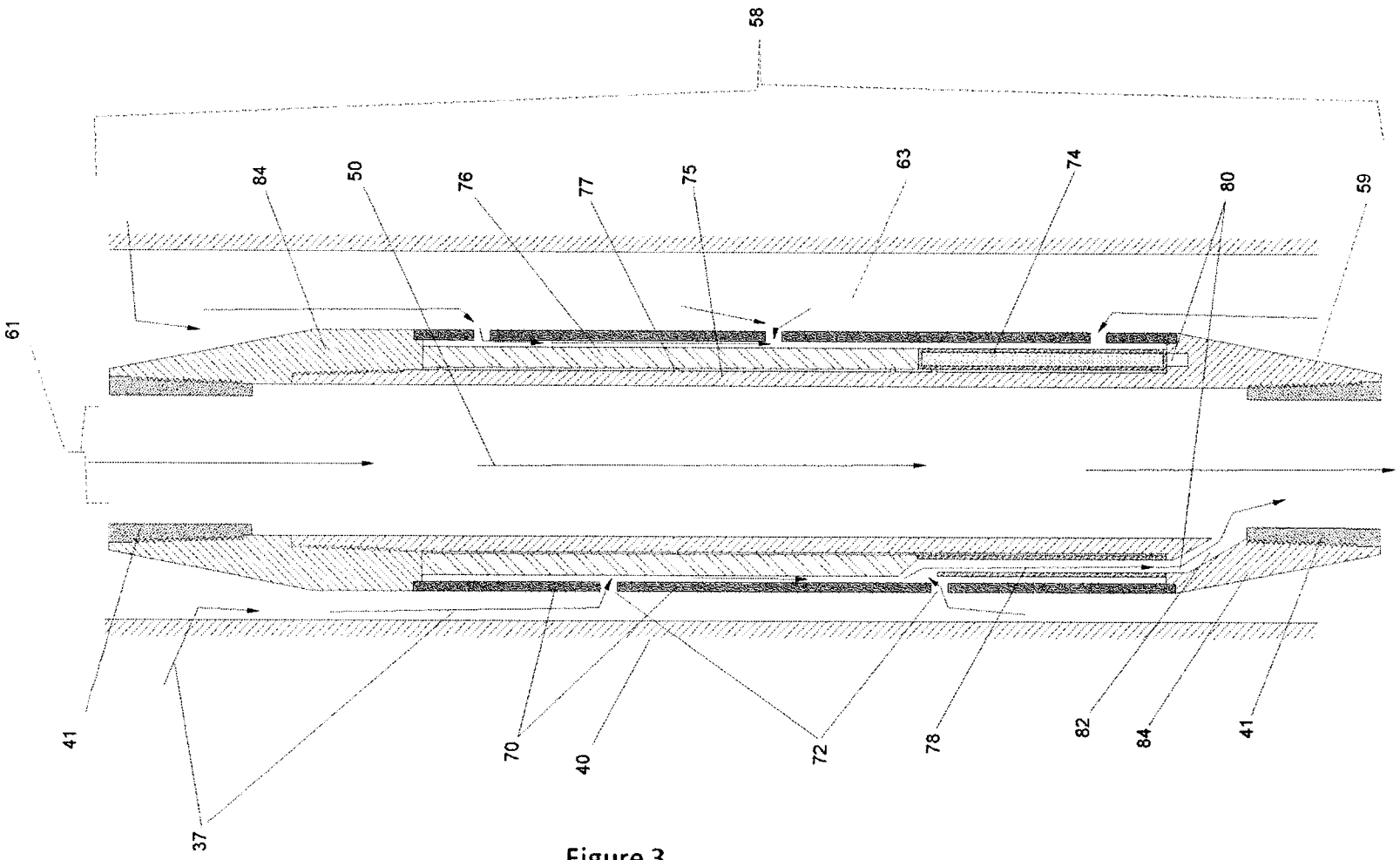
FIG. 3 shows a vertical cross section of the inflow control valve according to the present invention within a liquid filled production well casing.

The present invention, according to one preferred aspect as shown in FIG. 3, provides a valve body 75 including two co-operating sleeves, 74, 76 that are free to rotate on the valve body 75 around a longitudinal axis 50 of the production tubular 41. Connection means 60 are provided at either end of the valve body 75 to permit the valve body 77 to be secured to production tubing 41. The valve body 77 defines an internal through bore 61 that generally matches the internal diameter of the production tubing 41 to facilitate the passing of liquids along the production tubing 41 towards the riser portion. As shown the connection 41 most preferred is a threaded pin connection but other forms of connection are also comprehended. For example the connection could also be a box connection or any other form of connection that is suitable for use in connecting tools to production tubing.

The first sleeve 74 is rotationally mounted to the valve body 58 and weighted so it is biased generally towards an up-down orientation, by means of gravity to position inlet opening 72 towards a bottom of the valve body 75. The first sleeve 74 has internal flow passages 78 that provide a path for fluid 37 to drain from the annulus 63 into the production tubing 41. These internal flow passages 78 are preferentially located within the weighted part so that the flow passages have an inlet openings 72 onto the annulus 63 and which are preferably positioned at or near the bottom of the casing 40. However, the first sleeve 74 is not aligned to any specific position as outlined below the precise location of the inlet opening 72 varies.

Figure 4A:
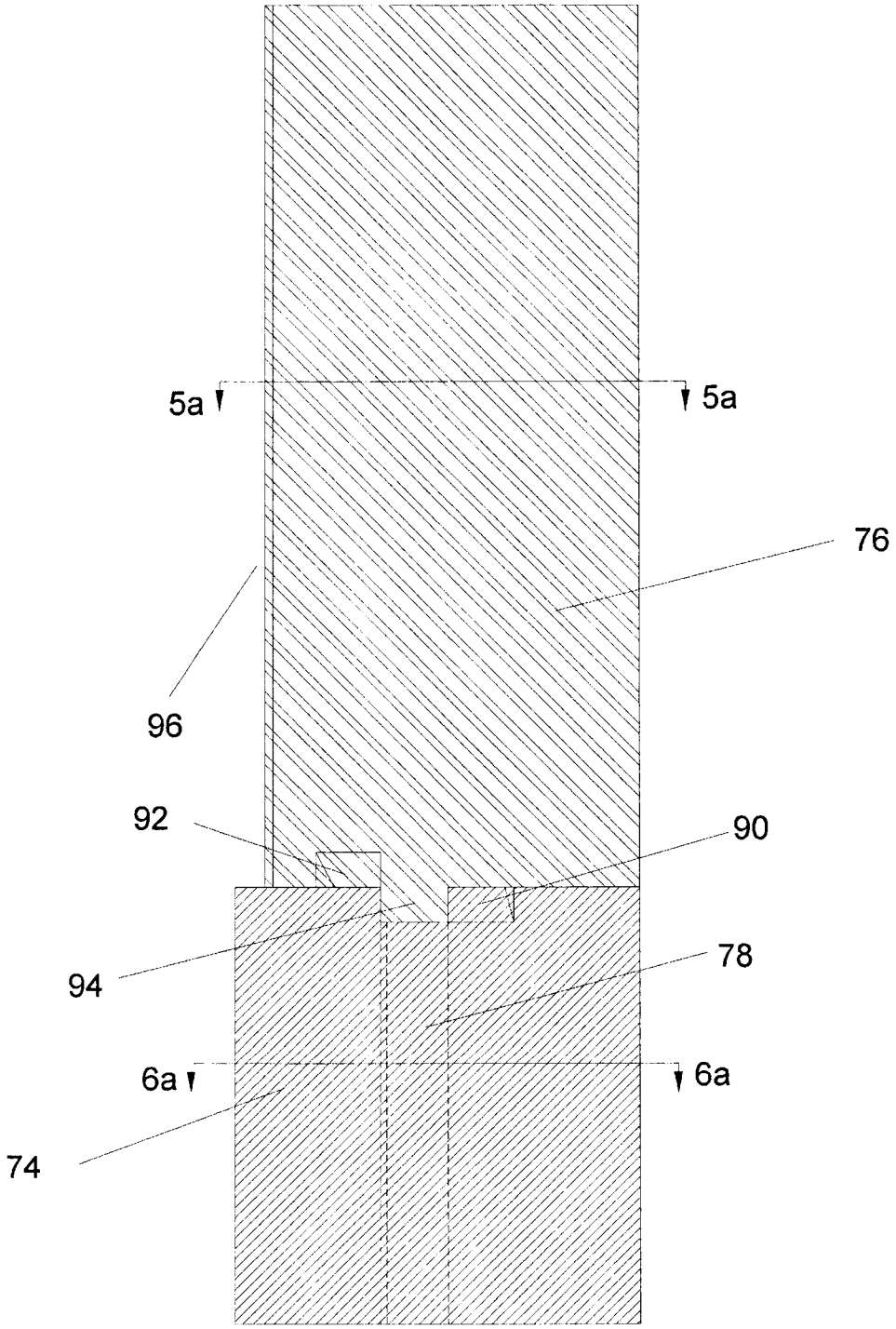
FIG. 4*a* shows a preferred arrangement of a valve body comprised of two co-operating sleeves as viewed from below when the annulus is drained of liquid and the inlet control valve is closed.
Figure 4B:
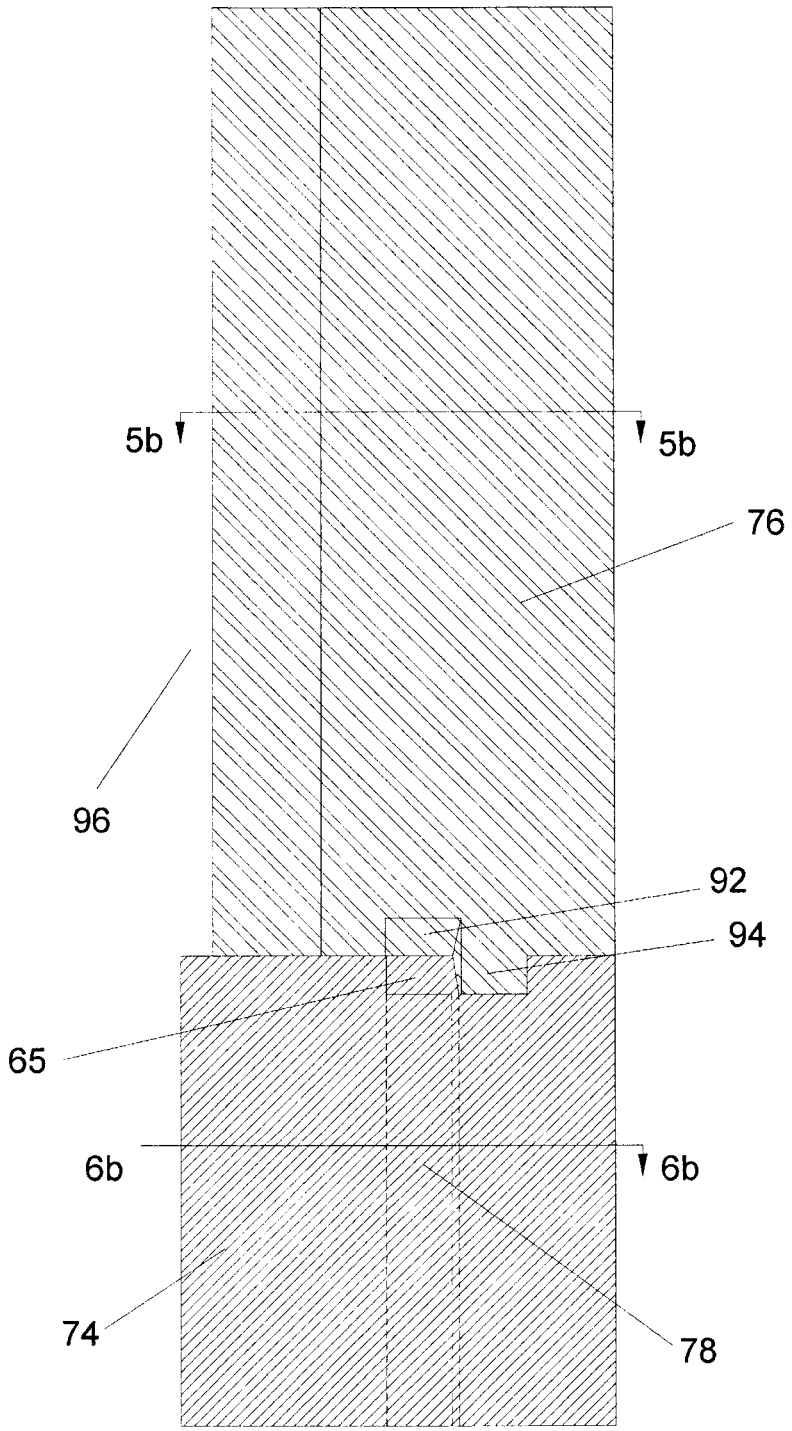
FIG. 4*b* shows the arrangement of FIG. 4*a* when the annulus is full of liquid so that the sleeves are submerged and the valve has opened to permit fluid flow.

The second sleeve 76 is located outside of the first sleeve 74 and rotates independently from the first sleeve 74 within a limited range of rotation. As shown in FIGS. 4*a* and 4B, the first sleeve 74 includes a notch 90 and the second sleeve 76 includes a tab 94 which is located with the first sleeve notch 90 and which is smaller than the notch 90. The notch 90 and tab 94 define the limit of the independent rotation of the first and second sleeves, as the tab 94 is free to move within the notch 90, but is then restricted when it engages either end of the notch 90 which limits its range of travel. As the tab 94 is mounted to the sleeve 76 it limits the range of free rotation of the sleeve 76. At one end of the notch 90 the tab covers the inlet opening 65 and at the other end of the notch 90 the tab uncovers the inlet opening 65. As shown it is most preferred if the two sleeves are at least part tubular and are nested one within the other, but other configurations are also comprehended. As will be understood from the description below, the interaction of the tabs 94 on the ends of the notch 90 changes the position and alignment of both the first and second sleeves.

The second sleeve 76 is sized and shaped to create a biasing force or rotational torque in a first direction when submerged in liquid and a biasing force or rotational torque in the opposite direction when the annulus is drained of liquid (i.e. filled with vapour) as explained in more detail below. According to a preferred aspect of the present invention the torque is developed by making one side 86 of the second sleeve 76 bulkier and heavier than the other side 96, so that side 86 is buoyant and rises when submerged but drops when exposed to a vapour. The sleeves 74, 76 can be fabricated from any durable material such as metal, such as steel and preferably stainless steel which is suitable for the aggressive environment downhole, and may be coated with a low friction or scale reducing coating.

FIG. 3 shows a vertical cross section of the valve 38 surrounded by the slotted casing 40 of the production well, according to the present invention. The bottom of the valve is at the left and the top at the right and the bottom of the valve 38 would likely be near the bottom of the casing 40. FIG. 3 shows the valve when it is submerged in a liquid 37 so the valve is biased by a buoyancy force into an open position to permit fluid to flow from the casing-tubing annulus into the production tubing 41. The buoyancy force of the second sleeve 76 is matched by an opposite biasing force created by the weight in the first sleeve 74. The fluid is driven into the tubing by the pressure difference or drawdown between the casing tubing annulus 63 and the production tubing. The production fluid 37 drains through holes 72, slots, screens or the like through an outer shell 70. The liquid flows past two rotatable sleeves 74 and 76 and through one or more internal passage(s) 78 in the first sleeve 74 then into a plenum 80.

The plenum 80 is a cylindrical channel which has one or more passages 82 connected to the interior of the production tubing 41. The plenum 80 is circularly symmetric so internal flow channel(s) 78 in the first sleeve 74 always provide an open fluid channel or central bore into the production tubing 41, and does not depend on the particular orientation of the sleeves 74 and 76, which as noted above do not align to any specific position.

The external shell 70 of valve would normally be in direct contact with the casing so the function of the external shell 70 is to provide the rotatable sleeves with a gap so they are free to rotate in response to gravity and fluid characteristics. The external shell 70 also helps improve the stiffness so that distortion is minimized and the sleeves 74 and 76 are free to rotate. The external shell may also be provided with an annular collar to further protect the sleeves from damage. In some applications, it may be desirable to prevent grit and sand from entering the valve 38 by filtering the fluid 37 through screen or slots in the shell 70. However, this can lead to pressure drop induced flashing. It is generally more desirable to have an open design that is tolerant to grit and encourages grit to pass through the valve 38 into the production tubing 41 without impairing the valve function.

The sleeves 76 and 76 may be mounted on one or more seals or wipers 77, which provide some protection against grit and also provide a gap between the sleeves and the pipe 75 to reduce viscous drag. The present invention further comprehends using bearings, such as sealed bearings, between the sleeves to provide rotational movement.

The first sleeve 74 is eccentrically weighted to use gravity to bias the first sleeve, but due to the interaction between the sleeves, it moves through a range of positions suitable to generate good opening and closing torque on said second sleeve. The present invention comprehends that the most preferred range of positions of the sleeve 74 are those in which the inlet openings 65 on the one or more flow channels 78 are positioned towards the bottom of the annulus 63 for optimum drainage of the fluid 37. As will be appreciated by those skilled in the art, the position of the inlet opening 65 can be located anywhere around the circumference of the valve body, but a generally lower position is the most preferred to permit more complete drainage from the annulus. The buoyancy sleeve 76 is designed to rotate in one direction when submerged in a liquid and rotate in the opposite direction when the liquid is drained. This relative rotation of the two sleeves either exposes or obstructs the inlet openings on the internal flow channels 78 thereby allowing fluid flow or blocking it.

FIGS. 4*a* and 4*b* show the co-operating sleeves 74, 76 in closed and open positions respectively as seen from the bottom.

In FIG. 4*a* the sleeve 76 has rotated clockwise so that a tab 94 is over the opening 65 to the internal fluid passage 78 (shown in dashed lines), thereby obstructing fluid flow through the valve. Cross sections 5*a* and 6*a* correspond to FIGS. 5*a* and 6*a* respectively.

In FIG. 4*b* the sleeve 76 has rotated counter-clockwise as tab 94 has uncovered the inlet opening to fluid passage 78 and rotated into a notch 90. As shown, a second notch 92 is now aligned with fluid passage 78 thereby allowing fluid flow into the inlet opening and through sleeve 74. Cross sections 5*b* and 6*b* correspond to FIGS. 5*b* and 6*b* respectively.

Figure 5A:
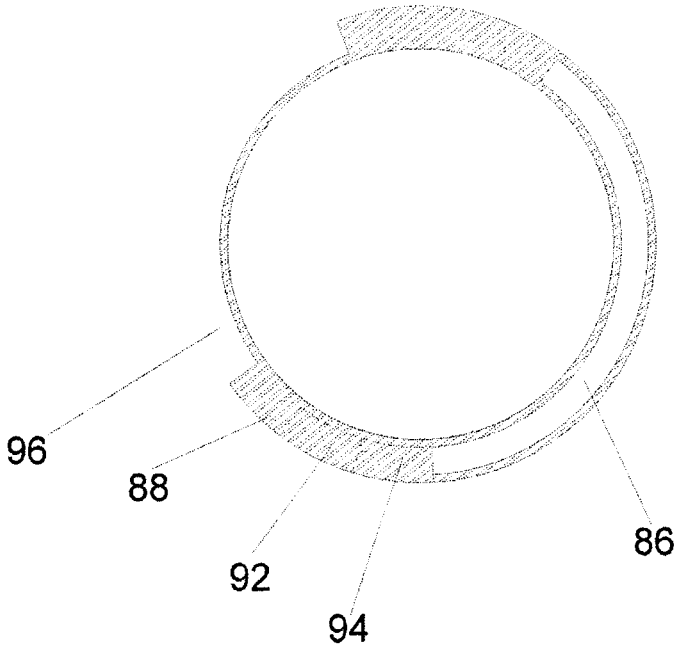
FIGS. 5*a* and 5*b* show a cross section through 5*a*-5*a* and 5*b*-5*b* of a valve closure member on the valve body having a position shown according to the conditions of FIGS. 4*a* and 4*b* respectively.
Figure 5B:
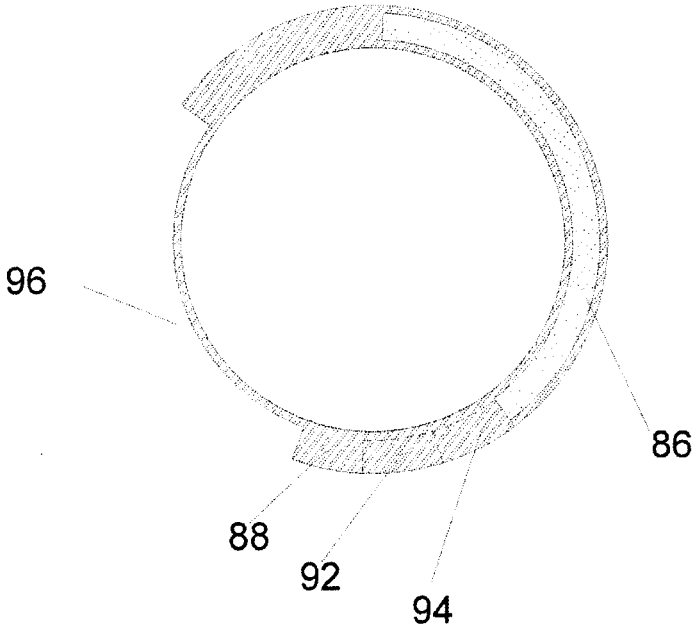

FIGS. 5*a* and 5*b* show a preferred orientation of the second sleeve 76 in the drained (closed) and submerged (open positions) respectively.

In FIG. 5*a*, the drained (closed) position, the second sleeve 76 rotates clockwise due to the weight on the right side than the left. The side with pocket 96 has a lower weight than the side with chamber 86. Chamber 86 may be filled with a silicone rubber or the like. The profile of the steel body 88 of sleeve 74 is not symmetric, so it also contributes to the torque. Although notch 92 and tab 94 are out of the plane of the cross-section, their positions are shown in dashed lines to help explain the valve actuation.

In FIG. 5*b*, the submerged (open) position, the second sleeve 76 rotates counter-clockwise because the side with chamber 86 is more buoyant than the side with pocket 96. Again notch 92 and tab 94 in sleeve 76 are out of the plane of the cross-section, but their positions are shown in dashed lines to help explain the valve actuation. It will be noted that the positions of the notch 92 and the tab 94 are not the same in FIGS. 5*a* and 5*b* which permits the sleeves to be positioned to generate the preferred opening and closing torque.

Figure 6A:
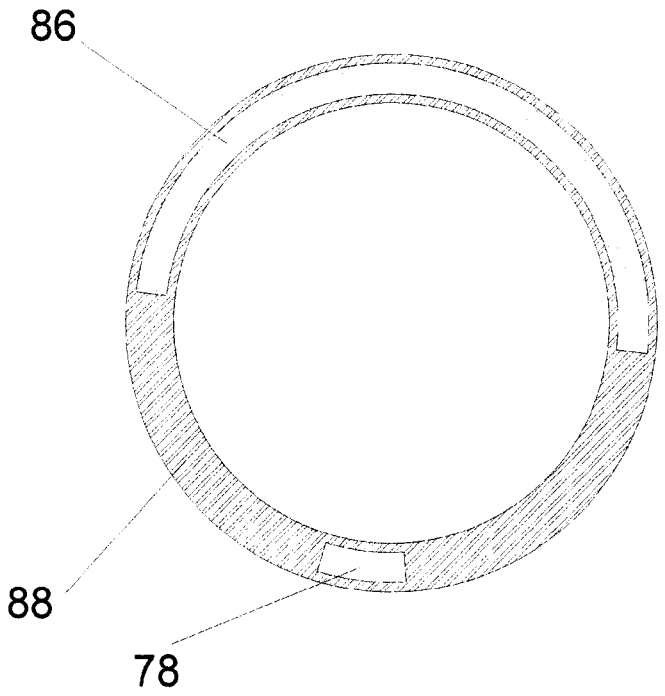
FIGS. 6*a* and 6*b* show a cross section along 6*a*-6*a* and 6*b*-6*b* of a valve body with a position corresponding the conditions of FIGS. 4*a* and 4*b* respectively.
Figure 6B:
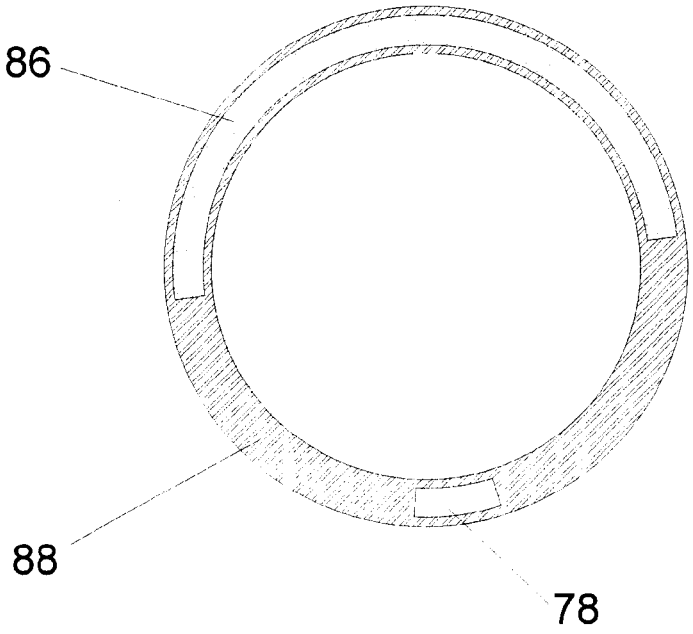

FIGS. 6*a* and 6*b* show the orientation of the first sleeve 74 in the drained (closed) and submerged (open positions) respectively. It will be appreciated that the first sleeve 74 is rotatably attached to the valve body or to the production tubing to permit the sleeve 74 to assume any position about a central axis of rotation.

In FIG. 6*a*, the drained (closed) position, the sleeve 74 rotates clockwise slightly due to the torque exerted on it by second sleeve 76. The flow passage 78 is rotated slightly clockwise away from the true bottom due to the torque exerted from sleeve 76 as the tab 94 reaches the end of travel in the notch 90. The present invention comprehends extending the size of the notch 90 to change the point of contact between the sleeve 76 and the sleeve 74, but the shown point of contact is generally preferred to prevent the valve components 74, 76 from having to move too much and thus delay a response time to a change of conditions at the inlet opening.

In FIG. 6*b*, the submerged (open) position, sleeve 74 rotates counter-clockwise due to the torque exerted by second sleeve 76. The flow passage 78 is rotated slightly clockwise away from the true bottom due to the torque exerted from second sleeve 76 as the tab 94 reaches the other end of the notch 90.

In FIGS. 6*a* and 6*b*, the torque exerted by the second sleeve 76, is offset by an equal and opposite torque from the sleeve 74. This opposing torque is developed by the eccentric weighting of sleeve 74, with one side being a dense material like steel and the other side 86 having a lower density, such as provided by a sealed chamber having a lower density material therein. As can now be appreciated the present invention provides for a biasing force, most preferably a buoyancy force, derived from the conditions existing in the annulus at the inlet opening, to motivate the components between the open and closed positions.

In the presence of a low density fluid (vapour), the torque on the second sleeve 76 causes the sleeve 76 to rotate into a position whereby the tab(s) 94 obstruct the inlet opening 65 of the flow passage(s) in the first sleeve 74 and thereby restrict flow into the first sleeve 74. When the second sleeve 76 is submerged in a liquid to be produced it experiences a torque in the opposite direction which makes the tab(s) 94 rotate away from the opening 65 to expose the internal flow passage(s) 78 allowing liquid to enter the first sleeve and subsequently drain into the production tubing.

The orientation and interlocking tabs of the second sleeve provide a large starting torque and limit the travel (rotation) to ensure that the valve response is rapid and reliable to changes in liquid submergence despite viscous resistance and friction from dirt.

Furthermore, the second sleeve 76 is fully exposed to all the fluids flowing into the wellbore annulus from the reservoir. The position of the drainage passages near the bottom of the first sleeve 74 ensures that the second sleeve 76 experiences a maximum fluid level change and consequently can develop maximum possible closing and opening torque. This is facilitated by the first and second sleeves being positionable through a range of positions during use, as opposed to being aligned with any predetermined orientation.

Since the first sleeve is free to rotate, any torque exerted by the second sleeve density sensing sleeve will be balanced by an opposing torque from the first sleeve. However the first sleeve is sufficiently weighted so that the first sleeve limits the change of position caused by the second sleeve. Consequently, the valve design will always correctly respond to the liquid level in the annulus and will open and close with a minimum of rotational movement needed by said tabs.

Figure 7A:
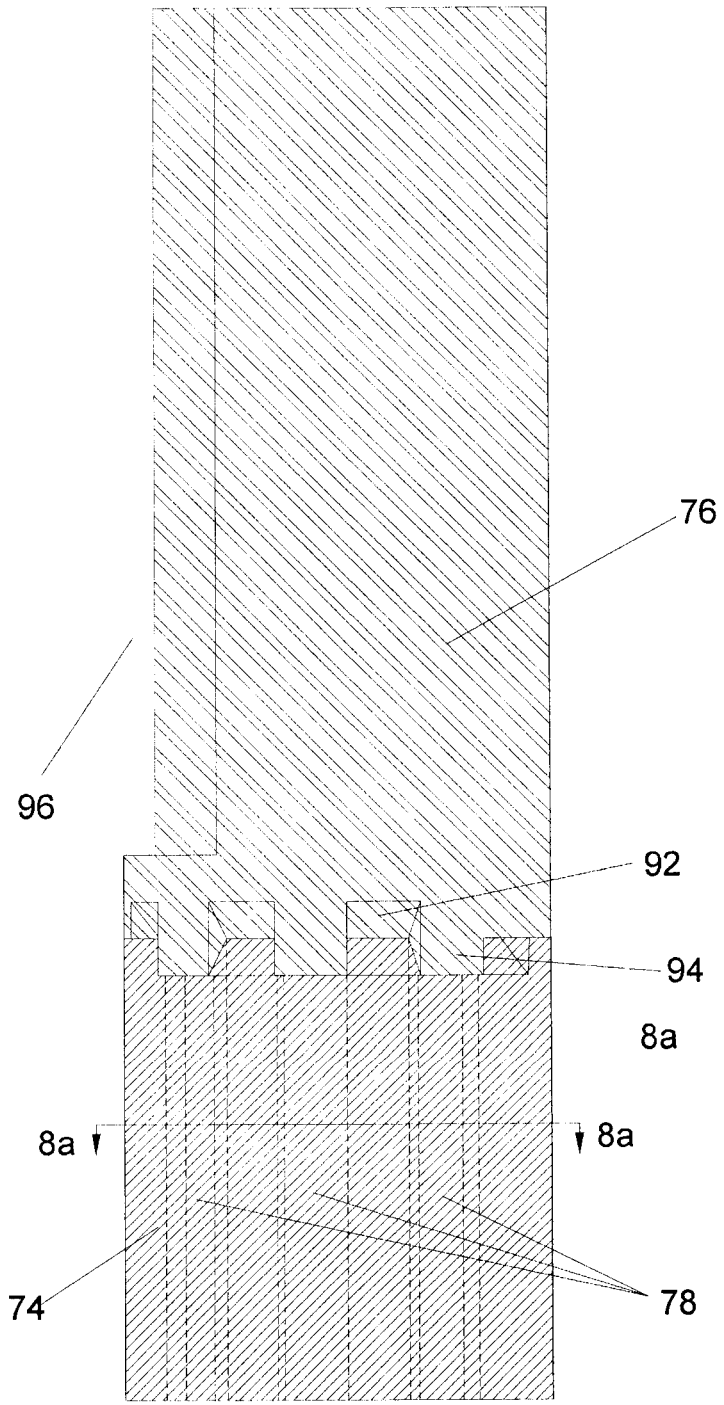
FIG. 7*a* shows a further embodiment of the present invention with multiple inflow passages through the valve body when the inlet control valve is in a closed position.
Figure 7B:
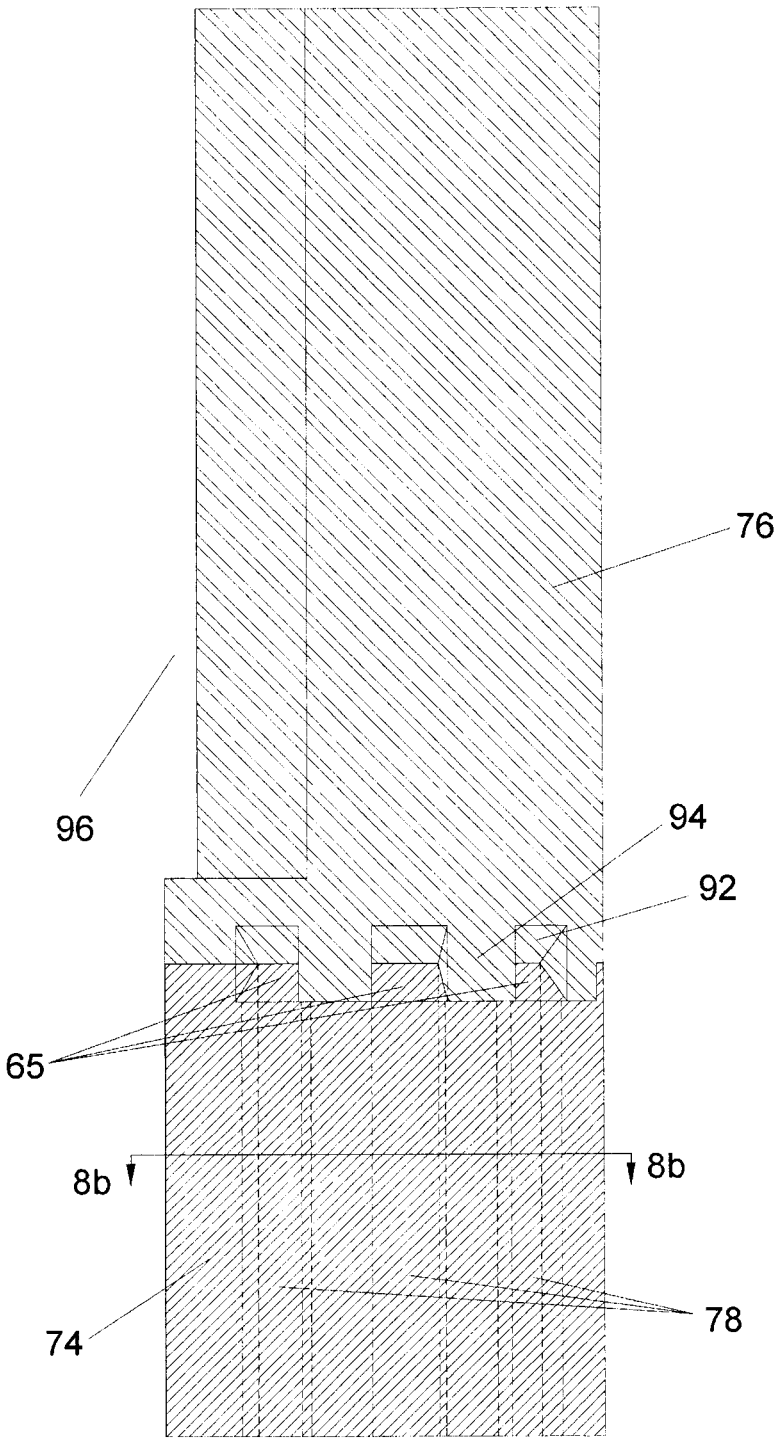
FIG. 7*b* shows the view of FIG. 9*a* when the inlet flow valve is open to permit fluid flow.

FIGS. 7*a* and 7*b* show the two co-operating sleeves in closed and open positions respectively in a multi-channel configuration according to a further embodiment of the present invention. In this embodiment, there are three flow channels 78 in sleeve 74 and three tabs 94 on density sensing sleeve 76. One advantage of this embodiment is that the flow area is tripled, so flow capacity through the valve from the annual into the production tubing is tripled. Some SAGD wells are extremely productive, consequently individual valves may have to pass large volumes of liquid water and hydrocarbon. The outer dimension of the valve is constrained by the inner diameter of the production liner or casing. Consequently, the use of multiple fluid passages 78 helps the valve pass much larger volumes of fluid while still only requiring a small rotation of sleeve 76 to achieve the desired rapid open-close functionality. This embodiment has the benefit of providing an increased flow capacity without increasing the amount of rotation required through the open-cycle. Consequently, the actuation response is designed to be just as fast as the previous embodiment of FIGS. 6*a* and 6*b*, without any significant deterioration of the starting torque available to open or close the valve. Furthermore by accessing more flow passages with a similar rotation angle, the design of FIGS. 7*a* and 7*b* help minimize the impact of friction and viscous resistance. Cross sections 8*a* and 8*b* in FIGS. 7*a* and 7*b* correspond to FIGS. 8*a* and 8*b* respectively. What is desired is to provide as much flow area as possible and the present invention comprehends that the area of flow through the valve openings can be equal to the cross sectional area of the production tubing.

Figure 8A:
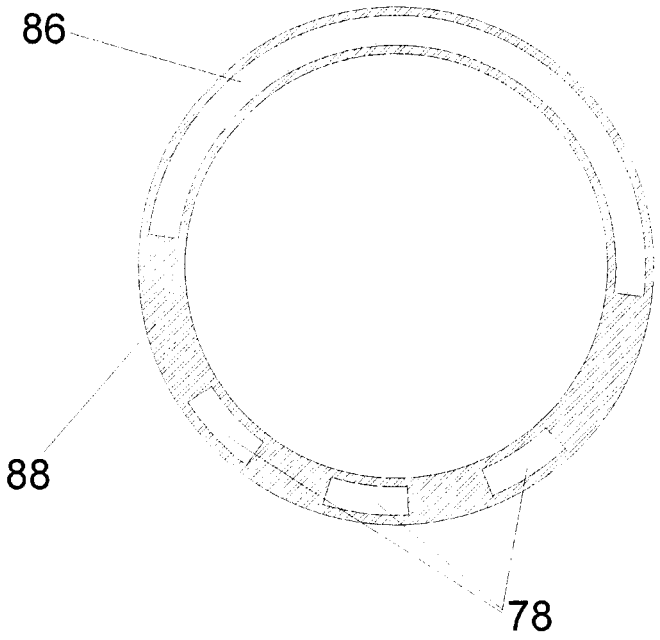
FIGS. 8*a* and 8*b* show a cross section along 8*a*-8*a* and 8*b*-8*b* of FIGS. 7*a* and 7*b;*
Figure 8B:
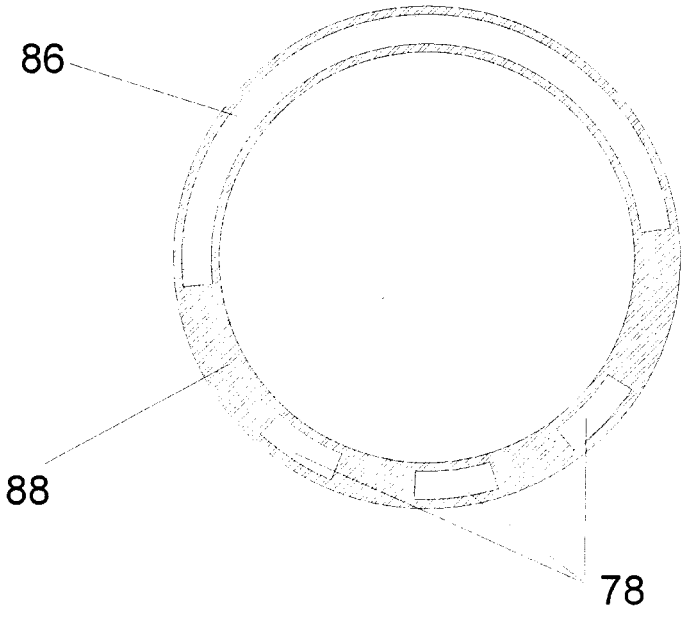

FIGS. 8*a* and 8*b* show the orientation of the first sleeve 74 which detects density in the drained (closed) and submerged (open positions) respectively for the embodiment of FIGS. 7*a* and 7*b*.

In FIG. 8*a*, the drained (closed) position, the sleeve 74 rotates clockwise due to the biasing force or torque exerted by the sleeve 76. The flow passages 78 are rotated slightly clockwise away from the true bottom due to the rotation exerted by the sleeve 76, again showing the range of positions that the device can assume.

In FIG. 8*b*, the submerged (open) position, sleeve 74 rotates counter-clockwise due to the biasing force or torque exerted by the sleeve 76. The flow passage 78 is rotated slightly clockwise away from the true bottom due to the rotation exerted by sleeve 76.

In FIGS. 8*a* and 8*b*, the biasing force exerted by the sleeve 76, is offset by an equal and opposite biasing force exerted by the sleeve 74. This opposing force is developed by the eccentric weighting of sleeve 74, with one side being a dense material like steel and the other side 86 having a low density, such as provided by a sealed chamber which may contain air, a vacuum, a light gas, a foam or the like. However, the exact orientation of the valve will vary with conditions within the annulus. Thus, if shown, the notches 90 would be displaced in FIGS. 8*a* and 8*b*.

Figure 9:
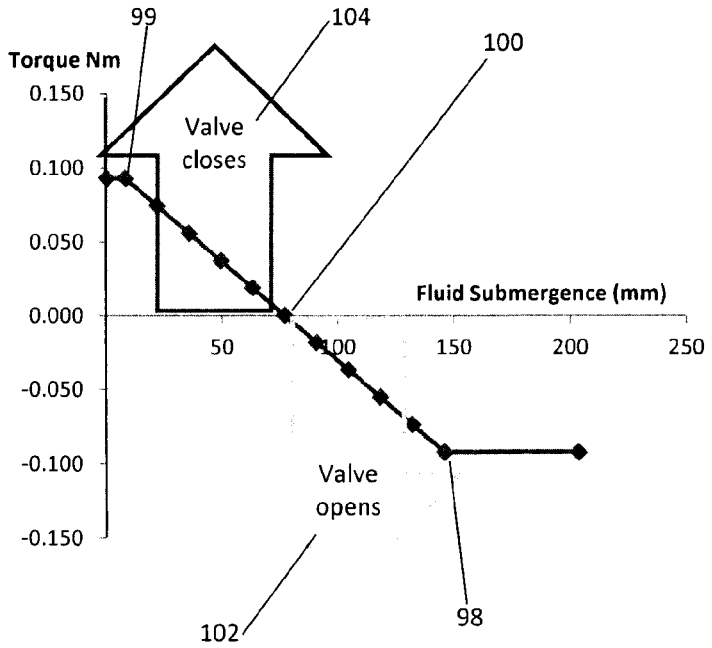
FIG. 9 shows the biasing force on the valve closure member varies with liquid submergence. The biasing force or torque on the valve closure is negative when the inlet opening is submerged and positive when drained.

FIG. 9 shows how the biasing force of the second sleeve 76 varies with the level of liquid submergence 98. The sleeve 76 experiences a rotational biasing force when the sleeve 76 is completely submerged in a liquid, such as mobilized bitumen and hot water. This biasing force will produce a counter-clockwise rotation of the second sleeve 76 thereby opening the valve 38, as depicted by reference numeral 102. Conversely if the environment outside of the sleeve 76 is drained of liquid it will experience a rotational biasing force in the opposite direction which tends to rotate the sleeve 76 in a clockwise direction to align the tab 94 with the inlet opening of the flow channel 78 effectively closing the valve 38, as depicted by reference numeral 104.

The graph of FIG. 9 shows that a point 100, where there is no biasing force on the second sleeve 76 to the open or the closed position which corresponds to a liquid level of about one half of the way up the side of the valve. When the liquid level is at the top of the valve 98 then the maximum biasing force is developed to open the valve and further liquid submergence does not increase the biasing force. When the liquid level is at the bottom of the valve 99, say at the level of the inlet openings, then the maximum biasing force in the opposite closing direction is developed. Further draining of the liquid to lower the liquid level has no further effect on the magnitude of the biasing force. It can now be appreciated how the present invention is able to control the inflow of liquids into the production well without regard to an amount or even a change in draw down pressure with a valve assembly that moves through a range of positions and alignments. Quite simply the present invention does not respond to the pressure drop across the valve to open and close, but only to a liquid level changes within the annulus at the location of the valve and only liquid level changes that span the outside diameter of the second sleeve 76.

It can also now be appreciated that the present invention comprehends developing the biasing force to open and close the valve through a change in liquid level in the annulus corresponding to the full height of the valve body, which means that small changes in liquid level, of an amount equal to the diameter of the production tubing, will cause the valve to open and close. Further, the present invention comprehends creating different buoyancy geometries to permit the valve to respond appropriately to different liquids. Depending on the reservoir conditions, some dampening of the opening and closing may also be provided.

The present invention also comprehends that the sleeve 76 may be configured, so the operating curve of FIG. 9 is asymmetric, with a low torque, slow opening cycle but a high torque rapid closing actuation. This arrangement would have the advantage of tending to fail in a closed position, thereby avoiding catastrophic steam venting. If one valve failed closed in this manner, then the adjacent valves could continue to drain the chamber and still provide steam trap control. This arrangement could potentially tolerate an individual valve failure without requiring that whole tubing string be removed from the well to replace a valve which failed in the open position.

The present invention also comprehends that the liquid level which corresponds to the point at which the second sleeve 76 is balanced can be adjusted to other levels of liquid submergence by changing the geometry (relative proportions of the chamber and the pocket or cavity) in the second sleeve. The maximum amount of torque developed by the sleeve 76 can also be increased or decreased by increasing the axial length of the sleeve 76 and/or the thickness of the sleeve wall to increase the biasing force to improve actuation as needed.

Friction and viscous effects can delay the opening and closing and could produce some hysteresis, leading to steam leakage. As can now be appreciated the present invention provides an opening or closing biasing force which is directly applied to open or close the valve 38 whatever the actual liquid level. Thus, the present invention provides a response which is both fast and reliable even in a dynamic and chaotic environment, where the liquid level changes quickly. As well the present invention provides this response in an environment where the biasing force is generated liquid level changes within a narrow band of +/−4 inches (+/−100 mm) corresponding to an internal diameter of the production liner.

Figure 10:
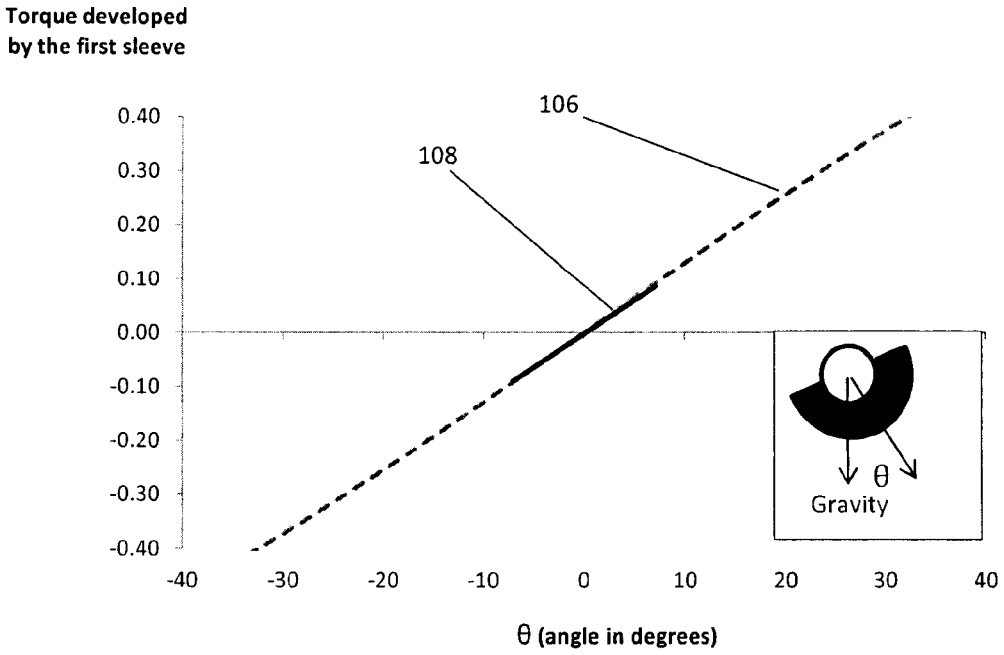
FIG. 10 shows the relationship between angle of the valve body and the torque exerted by its eccentric weighting. According to the present invention the maximum biasing force on the valve closure is small in comparison to the maximum orienting force of the valve body.

FIG. 10 shows the relationship between angle of the first sleeve 74 and the torque 106 exerted by the first sleeve 74. The angle θ is defined as the rotational angle around the pipe axis away from the direction of a gravitational vector (down). As noted above the mass is not evenly distributed about the circumference of the sleeve 74 leading to an eccentric weighting. This eccentric weight will seek to rest towards the bottom, within a range of positions as dictated by the interaction with the second sleeve 76, and the angle θ of FIG. 10 is zero. In other words, the angle θ is defined to be zero when the center of mass for the sleeve 74 is directly underneath the axis of rotation of the sleeve 74.

One aspect of the first sleeve 74 can now be better understood. As the second sleeve 76 is experiencing a counter-clockwise torque by being submerged in dense liquid, the first sleeve 74 is also dragged in a counter-clockwise direction due to tab 94 encountering the end of the notch 90. This counter-clockwise rotation of the first sleeve 74 lifts the eccentric weight and consequently the eccentric weight exerts a positive torque which opposes the direction of rotation of the second sleeve 76. Thus, the eccentric weighting of the first sleeve 74 will limit the rotational travel of the second sleeve 76 and thereby help to maintain the position of its internal flow channel 78 at the bottom of the valve 38.

FIG. 10 shows that according to a preferred aspect of the present invention the application of the full range of torques 108 exerted by the second sleeve 76, on the first sleeve 74, will only cause a rotation of the dominant sleeve 74 within a range of about, less than plus or minus 10 degrees. Thus, the present invention limits the range of travel for the second sleeve 76 and thereby preserving a significant amount of potential energy in the second sleeve so the second sleeve 76 experiences maximum possible torque. This contrasts with the meta-stable design of the prior art. Consequently, the valve has a large starting torque available to ensure reliable actuation, whether moving from the closed position to the open position or from the open position to the closed position.

Thus, according to the present invention the biasing force of the second sleeve 76 should not be capable of exceeding the maximum torque exerted by the eccentric weighting of the first sleeve 74. Most preferably the biasing force is some fraction of the maximum torque that could be developed by the first dominant sleeve 74, while at the same time permitting the appropriate positioning of the elements according to conditions in the annulus.

According to the present invention the frictional resistance to rotation should be made as small as reasonably practical. If the torque is insufficient to overcome friction in a timely manner, then the torque can be augmented by changing the weighting or dimensions as discussed above. The present invention therefore comprehends using special high density or low density materials.

As can now be understood the present invention further comprehends using wipers and seals 77 as appropriate to reduce overall loss of performance due to sand or other particular intrusion. Further, the elements of the present invention may be coated with friction reducing or wear enhancing coatings to ensure good performance and reduce the likelihood of scale build up or the like.

Figure 11:
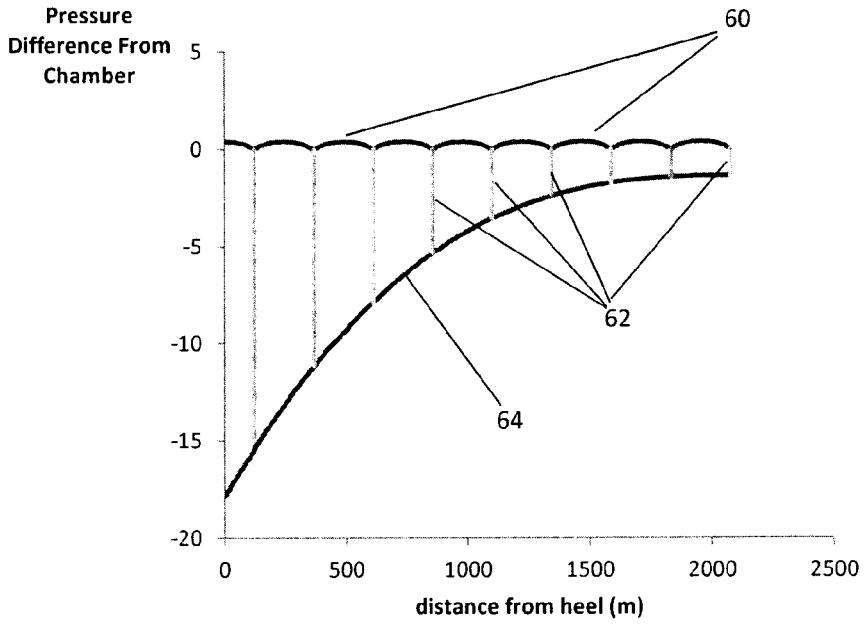
FIG. 11 shows representative pressure profiles along the production well according to said invention, including the pressure profile within the casing-tubing annulus, the pressure profile within the production tubing and the pressure drop across representative inflow control valves according to the present invention.

FIG. 11 shows a graph with pressure profiles along a hypothetical production well according to the present invention. The pressure profile in the casing-tubing annulus 60 is shown as substantially constant along the entire length of the horizontal well, representing is good drainage (very little flooding) in the liquid sump at the bottom of the chamber.

Each valve permits additional liquid to enter into the production tubing so the flow rate of produced fluids inside the production tubing increases as the fluid moves from toe to heel. Consequently, the pressure gradient within the production tubing 64 becomes steeper towards the heel. The pressure drop or drawdown across the individual valves 62 varies along the length of the production tubing. The drawdown 62 is quite large near the heel and much smaller towards the toe of the well. Thus an important feature of the invention is that the inflow control valves flow rate should not be directly determined by a pressure drop 62 across any individual valve. Instead according to the present invention the drainage rate for any valve should only be determined by the liquid submergence of the inlet opening at the valve inlet. The response to a high pressure drawdown, such as experienced by valves near the heel, is simply to spend a larger proportion of time closed and a shorter proportion of time open.

A primary function of the artificial lift 52 (in FIG. 2) is to ensure that there is adequate pressure drawdown along the entire length of the production tubing to ensure that the valves, especially near the toe where the drawdown is smaller, can pass enough liquid to properly drain the chamber 18 and avoid having the liquid/vapour interface 35 rise and submerge the injection well 34.

Figure 12:
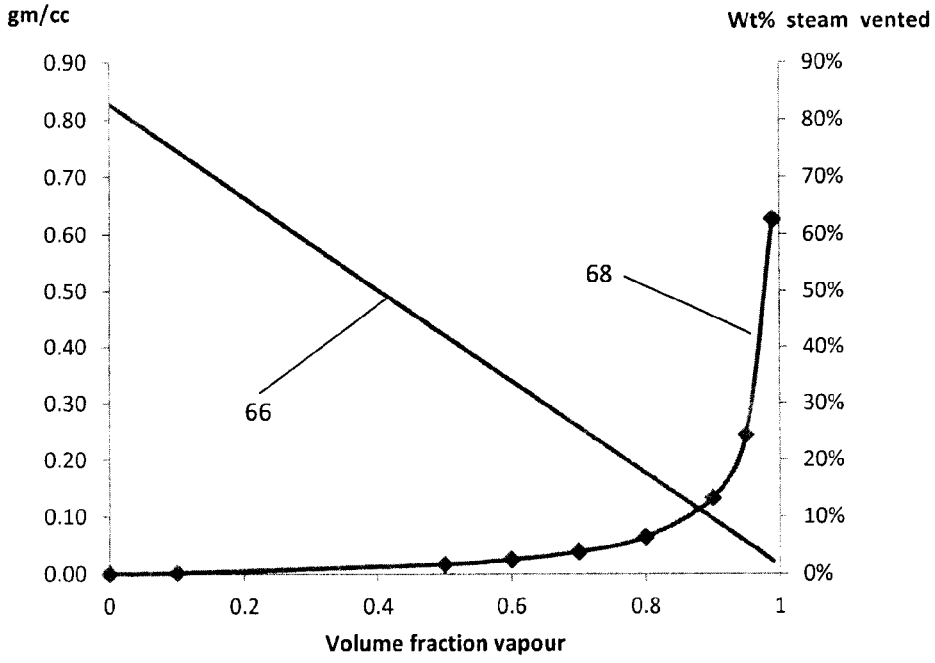
FIG. 12 is a graph illustrating the relationship between volume fraction of steam vapour in a water-steam froth or foam, the density of the foam and weight of the vapour phase in the foam.

The inflow control valve of the present invention also comprehends that in certain production conditions the liquid in the well casing in the annulus may be foamy. FIG. 12 shows a graph depicting the relationship between a volume fraction of steam vapour in a water-steam foam, the density of the foam 66 and weight fraction of the vapour 68 in the foam. It is assumed that the reservoir extraction chamber is substantially at the condensation temperature of the steam which was taken to be 230 C for this graph. Injected steam delivers its latent heat to the reservoir by condensing. Consequently, steam vapour losses into the production tubing, where the steam is in the foam, represent a direct source of heat loss. However, FIG. 12 shows that a relatively large volume fraction of vapour, say 50%, only represents a relatively small mass fraction of vapour 2%. This is because the liquid is 30-100 times denser than the vapour. Consequently, a large change in fluid density corresponding to a large change in apparent fluid level 80%, only corresponds to a relatively small energy loss, of less than 10%, of latent steam heat. Thus, the present invention comprehends selecting an appropriate biasing force based on buoyancy. Such an appropriate biasing force can permit some foam which unavoidably contains steam vapour to pass into the production well, without suffering excessive steam energy losses, even if the foam density is less than that of the expected liquid phase. Thus, using the buoyancy biasing force to trigger valve actuation is still useful for difficult applications like foamy fluids that do not separate into distinct phases and so trap the steam.

More specifically referring to FIG. 9, the neutral point 100 could actually correspond to complete submergence in foam which is a 50/50 volume fraction of liquid and vapour. FIG. 12 shows that the weight fraction of vapour is about 2%. Thus, in the worst case scenario of a foamy liquid, at the point 100, of FIG. 11, 98% of the latent heat has been successfully delivered (i.e. 98% wt % of the steam has condensed to form water) and only 2% is vented into the production tubing.

Consequently, when the heat loss exceeds 2%, the torque on the valve will change direction and try to close the valve instead of trying to open it. Similarly the torque on the valve will try to hold the valve open if the venting heat loss is less than 2% (i.e. more than 98% of the latent heat has been successfully delivered to the formation).

The physical design principles outlined above were specifically intended for a SAGD application where the valve function is to provide the equivalent of a steam trap by allowing liquid to open the valve and to pass and where there is an absence of liquid (i.e. a vapour present) the valve closes to prevent the vapour from passing. However, the same design principles can be applied to other multiphase production problems in horizontal wells. For example, it may be desirable to encourage gas production and minimize water coning in some gas wells. In this case the logic is reversed as the valve should open when drained and close when flooded with liquid water. In this case the fluid flow passage in the first dominant sleeve might preferentially be positioned at the top (i.e. on the opposite side to the eccentric weight).

Similar to the SAGD example, there may be certain applications of the valve in horizontal wells where one wants to produce a crude oil but minimize the amount of gas or solvent vapour production.

In operation the present invention is unaffected by pressure draw down and geysering because the direction of opening and closing is orthogonal or across the inlet opening and is controlled by the liquid level at the inlet opening as directly exposed to the annulus only as set out above.

In some circumstances the function of the valve may be further enhanced by isolating individual valves through the use of packers or some other sealing means in the casing-tubing annulus. This would enhance the ability of the valve to apply high drawdown to colder and more viscous locations within the horizontal production well, without drawing in excessive fluid from adjacent warm sections. As well, insulated tubing, as known in the art, could be used to prevent countercurrent heat exchange along the production tubing from the toe to the heel. This, in conjunction with better drainage control, could also help extend the horizontal well length.

The function of the valve may also be enhanced by the use of insulated tubing, particularly towards the heel of the well where the drawdown is largest and flash cooling most severe. Insulated tubing limits the heat transfer between the tubing and the casing tubing annulus, allowing the fluid within the tubing to cool off due to flashing. Thus, insulated tubing can enable more drawdown to be applied to the production tubing. This is particularly useful for ensuring adequate drainage for extended length horizontal wells.

Some of the benefits of the present invention can now be understood, including the reduced steam consumption required to produce a barrel of oil, lower unit capital and operating costs, and increased horizontal well length as compared to the prior art. Furthermore use of the present invention will allow horizontal wells to be more tolerant of unknown and perhaps unknowable geological heterogeneities such as pay thickness, permeability, porosity, oil saturation, baffles etc.

By reducing the amount of steam consumption needed to produce a barrel of oil, the use of the invention will reduce water requirements, fuel energy requirements and significantly reduce greenhouse gas emissions.

The industry typically characterizes thermal efficiency in terms of steam to oil ratio. However, this criteria is misleading as applied to individual wells, because steam injected into one well can easily migrate to an adjacent wells. A more useful criteria for assessing the heat balance comes from the produced water to oil ratio (WOR). This ratio indicates the amount of heat consumed (i.e. water condensed) within the drainage region of a specific well to mobilize the oil produced by that same well.

A representative SAGD production well may have an overall water oil ratio of about 3 and a total production of about 20 million barrels of fluids. This means almost 15 million barrels of water and about 5 million barrels of oil were produced. If the ideal or theoretical WOR is 1.8, as described earlier, based on the heat balance, then one can infer that almost 6 million barrels of live steam was vented into the production well. If this steam had been efficiently utilized for recovery, it would have enabled production of an additional 3.3 million barrels of oil worth about $200 million dollars at current prices. Publically available SAGD production data for 2010 suggests that an estimated 350,000 bbl/day of steam are currently used in excess of the theoretical minimum, meaning that it was wasted. At energy efficient steam oil ratio's, this wasted steam could would potentially have delivered an additional 200,000 bbl per day of bitumen production, worth about $12 million per day or about $4 billion per year. This incremental oil extraction does not incur any incremental GHG emissions as it uses steam that would otherwise have been wasted.

Additional advantages of the present invention can now be appreciated. Current drilling technology is capable of horizontal wells as long as 14 km, yet horizontal SAGD wells are typically quite limited in length (typically 1 km or less). This short well length is dictated at least partially by fluid drainage problems, caused by high permeability zones in the formation which lead to potholing and pancaking. By improving drainage the present invention may be used to enable longer wells, which in turn offers potential for significant capital savings. Further each additional wellbore penetration though the upper confining layer carries some risk of a poor cement seal and steam or fluid loss into overlying geological strata. By reducing the number of such penetrations such risks are also reduced. The use of fewer and longer wells to access the underground resource can also greatly reduce the environmental footprint on the surface due to land disturbance.

Further, the present invention will reduce the volume of oil accumulation in the sump, by effectively draining towards the bottom of the annulus so oil production revenue is accelerated and the overall rate of return enhanced.

A further advantage of the invention is with improved drainage the injection and production wells may be placed closer together, greatly reducing the startup time. Conventionally the distance is at present 5 meters, but the present invention can enable a shorter separation distance of four three and in some cases two meters separation. This would enable more rapid and reliable startup. A further advantage is that by improving drainage, the invention also enables greater drawdown to be applied to flooded portions of the horizontal well, thereby helping to eliminate the risk of differential drainage problems.

A further benefit of the invention is that the drainage rate is inherently appropriate so unknown reservoir heterogeneities, such as varying pay thickness, baffles and other geological factors which are expensive to characterize do not impair thermal efficiency. The present invention provides local and instantly responsive control, so there is no need for hugely speculative geological assumptions.

A further benefit of the invention is that only a small portion of the oilsand resource is economic to recover, most of the resource requires excessive amounts of thermal energy, for example, thin pay zones and carbonate zones are well known to have very high steam oil ratios. A valve such as the present invention, that can minimize steam losses and thereby reduce excess steam consumption may enable some portion of this stranded resource to become economically recoverable.

The present invention is also physically robust enough to withstand large compressive stresses, especially if the well is very long and the tubing must be displaced some distance along a horizontal section.

It will be appreciated that while the foregoing description relates to preferred embodiments of the present invention, other variations are comprehended without departing from the broad spirit of the invention as defined by the appended claims. Some of these variations have been discussed above and others will be apparent to those skilled in the art.

The embodiments of the invention in which an exclusive property or privilege is claimed are defined as follows:

1. An inflow control valve for controlling the flow of fluids into a generally horizontal production well located in an underground reservoir, said production well having a well casing, production tubing located within the casing and an annulus between said production tubing and said casing, said inflow control valve comprising:

a valve body having means for connecting the valve body to said production tubing, a through bore for connecting to an inside bore of said production tubing and an outside surface;

an inlet passageway extending through said valve body between said outside surface and said through bore;

an inlet opening on said inlet passageway formed on said outside surface of said valve body;

a closure member for opening and closing said inlet opening, said closure member being located between said inlet opening and said annulus; and a means to bias said closure member to an open position when said inlet opening is submerged in a liquid to be recovered from said reservoir and to bias said closure member to a closed position in the absence of said liquid at said inlet opening;

wherein said closure member is in the form of a second rotatable sleeve having an axis of rotation located on an center line axis of said through bore through said valve body; and wherein said valve body includes a first rotatable sleeve nested within said second rotatable sleeve and having the same axis of rotation.

2. An inflow control valve as claimed in claim 1 wherein said inlet opening is positioned towards a bottom of said valve body.

3. An inflow control valve as claimed in claim 1 wherein said means to bias said closure member comprises a float operatively connected to said closure member to open said closure member when said float is submerged in an appropriate liquid.

4. An inflow control valve as claimed in claim 3 wherein said means to bias said closure member further includes a weight, to bias said closure member to a closed position when said float is not submerged in said liquid.

5. An inflow control valve as claimed in claim 4 wherein said float and said weight are sized and shaped to permit a buoyancy force generated by said float when said float is submerged in a said liquid to overcome said weight to move said closure member.

6. An inflow control valve as claimed in claim 5 wherein the rotatable second sleeve at least partially surrounds said valve body.

7. An inflow control valve as claimed in claim 6 wherein the rotatable first sleeve is positioned between said second sleeve and an inside of said production well.

8. An inflow control valve as claimed in claim 7 wherein said first sleeve includes said at least one inflow passageway.

9. An inflow control valve as claimed in claim 8 wherein said first sleeve includes at least one inflow opening located between said inflow passageways and said annulus.

10. An inflow control valve as claimed in claim 9 wherein said second sleeve includes a tab to cover said at least one inflow opening when said inflow control valve is in the closed position.

11. An inflow control valve as claimed in claim 10 wherein said first sleeve includes a notch to permit said tab to move between an open and a closed position.

12. An inflow control valve as claimed in claim 7 wherein said first sleeve is weighted to bias said first valve to a preferred position by gravity.

13. An inflow control valve as claimed in claim 12 wherein said first sleeve includes an inflow opening for said inlet passageways and wherein said inlet opening is position towards a bottom of said sleeve when said first sleeve is biased to said preferred position by said weight to better drain said annulus.

14. An inflow control valve as claimed in claim 13 wherein said notch is sized to limit the movement of said tab away from said inflow opening.

15. An inflow control valve as claimed in claim 14 wherein said second sleeve biases said first sleeve away from said preferred position when said tab is limited by contact with said notch.

16. An inflow control valve as claimed in claim 15 wherein said weight of said first sleeve overcomes a buoyancy force generated by said second sleeve to hold said inlet opening towards a bottom of said annulus.

17. An inflow control valve as claimed in claim 1 wherein said outside surface includes a guard to protect said closure member from contacting said casing.

18. An inflow control valve as claimed in claim 1 wherein said closure member opens and closes in a manner which is generally orthogonal to any drawdown pressure applied across the valve body between the annulus and the through bore.

19. An inflow control valve as claimed in claim 18 wherein the biasing force generated to open and close said closure member is independent from any drawdown pressure applied between the annulus and said through bore.

20. A method of controlling the flow of fluid into a horizontal production well located within a casing and having an annulus formed between the casing and the production well, the casing and the horizontal production well being located within an underground hydrocarbon reservoir, the method comprising the steps of:

providing at least one inlet flow control valve in said horizontal production well which opens and closes in accordance with a liquid immersion level of said valve;

injecting a vapour into an underground formation above said production well to reduce a viscosity of in situ hydrocarbons sufficiently so that the hydrocarbons can drain as a liquid towards and into said production well; and permitting liquid to pass through said inflow control valve when said annulus is at least partially full of said liquid and thereby limiting vapour from passing into said production tubing;

wherein said inflow control valve comprises:

a valve body having means for connecting the valve body to said production tubing, a through bore for connecting to an inside bore of said production tubing and an outside surface;

an inlet passageway extending through said valve body between said outside surface and said through bore;

an inlet opening on said inlet passageway formed on said outside surface of said valve body;

a closure member for opening and closing said inlet opening, said closure member being located between said inlet opening and said annulus; and a means to bias said closure member to an open position when said inlet opening is submerged in a liquid to be recovered from said reservoir and to bias said closure member to a closed position in the absence of said liquid at said inlet opening;

wherein said closure member is in the form of a second rotatable sleeve having an axis of rotation located on an center line axis of said through bore through said valve body; and wherein said valve body includes a first rotatable sleeve nested within said second rotatable sleeve and having the same axis of rotation.

21. A method of controlling the flow of fluid into a horizontal production well as claimed in claim 20 wherein said step of permitting liquid to pass though said inflow control valve includes the step of proving a float to create a biasing force to open said inflow control valve when said inflow control valve is sufficiently submerged in said liquid.

22. A method of controlling the flow of fluid into a horizontal production well as claimed in claim 21 further including the step of applying a drawdown pressure across said production well without affecting the biasing forces developed to open and close said inflow control valve by said weight and said float.

23. A method of controlling the flow of fluid into a horizontal production well as claimed in claim 22 further including the step of increasing the drawdown pressure to improve drainage from said formation while preventing an increase in production of vapour from said production well due to said increased drawdown pressure.

24. A method of controlling the flow of fluid into a horizontal production well as claimed in claim 20 wherein said step of permitting liquid to pass though said inflow control valve includes the step of proving a weight to create a biasing force to close said inflow control valve when said inflow control valve is not sufficiently submerged in said liquid.

25. A method of controlling the flow of fluid into a horizontal production well as claimed in claim 20 further including the step of extending the length of said horizontal production well by placing inflow control valves along said length to improve drainage from said formation.

26. An inflow control valve for controlling the flow of fluids into a generally horizontal production well located in an underground reservoir, said production well having a well casing, production tubing located within the casing and an annulus between said production tubing and said casing, said inflow control valve comprising:

a valve body including at least one inlet flow control orifice; and a submergence responsive means operatively connected to said orifice having an upstream side in fluid communication with a fluid in said annulus and a downstream side in fluid communication with production tubing, wherein said submergence responsive means opens and closes access to said orifice in response to liquid level changes of said fluid in said annulus, to maintain a desired amount of liquid submergence at the inlet orifice;

wherein said submergence responsive means is in the form of a second rotatable sleeve having an axis of rotation located on an center line axis of a through bore through said valve body; and wherein said valve body includes a first rotatable sleeve nested within said second rotatable sleeve and having the same axis of rotation.

* * * * *